US007237286B1

(12) United States Patent
Kim

(10) Patent No.: US 7,237,286 B1
(45) Date of Patent: Jul. 3, 2007

(54) ARTICULATING BED

(76) Inventor: Willie W. Kim, 2124 W. Cherrywood La., Anaheim, CA (US) 92804

( * ) Notice: Subject to any disclaimer, the term of this patent is extended or adjusted under 35 U.S.C. 154(b) by 0 days.

(21) Appl. No.: 11/336,238

(22) Filed: Jan. 20, 2006

(51) Int. Cl.
*A47B 7/00* (2006.01)
*A47B 7/02* (2006.01)

(52) U.S. Cl. ..... 5/613; 5/617; 5/618

(58) Field of Classification Search ..... 5/607, 5/608, 610, 617, 111, 609, 613, 618, 934
See application file for complete search history.

(56) References Cited

U.S. PATENT DOCUMENTS

| | | | | |
|---|---|---|---|---|
| 131,488 | A * | 9/1872 | Wilkes | 5/617 |
| 185,779 | A * | 12/1876 | Praul | 5/242 |
| 5,090,071 | A * | 2/1992 | Bathrick et al. | 5/618 |
| 5,205,004 | A | 4/1993 | Hayes et al. | |
| 5,468,216 | A * | 11/1995 | Johnson et al. | 601/24 |
| 5,515,561 | A | 5/1996 | Suggitt et al. | |
| 5,537,701 | A | 7/1996 | Elliott | |
| 5,568,661 | A | 10/1996 | Bathrick et al. | |
| 5,747,129 | A * | 5/1998 | Malofsky et al. | 428/36.4 |
| 6,360,386 | B1 * | 3/2002 | Chuang | 5/618 |
| 6,393,641 | B1 | 5/2002 | Hensley | |
| 6,789,280 | B1 | 9/2004 | Paul | |
| 6,826,793 | B2 | 12/2004 | Tekulve | |
| 2003/0121098 | A1 | 7/2003 | Wei | |
| 2005/0160530 | A1 | 7/2005 | Taguchi et al. | |
| 2005/0166323 | A1 | 8/2005 | Kawakami et al. | |

FOREIGN PATENT DOCUMENTS

| | | | |
|---|---|---|---|
| EP | 0581474 | | 4/1997 |
| GB | 2269916 | | 2/1994 |
| WO | WO 03/073973 | * | 9/2003 |
| WO | WO 2004/018901 | | 3/2004 |

* cited by examiner

*Primary Examiner*—Patricia Engle
*Assistant Examiner*—Gilbert Lee
(74) *Attorney, Agent, or Firm*—Knobbe Martens Olson & Bear LLP

(57) ABSTRACT

An articulated bed has a stationary frame and a plurality of mattress support sections defining a mattress support area, the support sections including: a left section, a right section, a head section and a foot section. The left and right sections are hingably interleaved so that by raising either one, a patient may be rolled over or moved laterally. A plurality of lift arms and lift drivers are engaged with the stationary frame for moving each of the support sections between a horizontal position and an elevated position. The sections may be elevated individually or in concert.

29 Claims, 6 Drawing Sheets

ARTICULATING BED

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to articulating beds and more particularly to an articulating hospital or convalescent bed that enables the turning of a patient in a superior manner.

2. Description of Related Art Including Information Disclosed Under 37 CFR 1.97 and 1.98

Dawakami et al, US 2005/0166323 and Taguchi et al., US 2005/0160530 each discloses a movable bed; Wei, US 2003/0121098 discloses a turning mechanism for a patient confined to a bed; Tekulve, U.S. Pat. No. 6,826,793 discloses an articulating bed frame; Paul, U.S. Pat. No. 6,789,280 discloses an articulated medical bed; Hensley, U.S. Pat. No. 6,393,641 discloses an articulated bed frame; Hayes et al., U.S. Pat. No. 5,205,004 discloses a vertically adjustable and tiltable bed frame; Suggitt et al., U.S. Pat. No. 5,515,561 discloses an articulating bed; Elliott, U.S. Pat. No. 5,537,701 discloses an adjustable articulated bed; Bathrick et al, U.S. Pat. No. 5,568,661 discloses an articulated bed with frame mounted power module; EP 0581474 discloses bed configurations; GB 2269916 discloses a hospital bed; and WO 200/018901 discloses a linear actuator.

The related art described above discloses several bed frames that have partial or full movement and tilt. However, the prior art fails to disclose an articulated frame such as described herein and especially fails to describe how an articulated bed may have interleaved sections. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

An articulated bed has a stationary frame upon which rests a plurality of mattress support sections defining a mattress support area, the support sections including: a left section, a right section, a head section and a foot section. The left and right sections are hingably interleaved so that by raising either one, a patient may be rolled over or moved laterally. A plurality of lift arms and lift drivers are engaged with the stationary frame for moving each of the support sections between a horizontal position and an elevated position. The sections may be elevated individually or in concert. Because the left and right sections each encompass more than one-half of the mattress support area, the raising of either one is highly efficient in turning a patient.

A primary objective inherent in the above described apparatus and method of use is to provide advantages not taught by the prior art.

Another objective is to provide a hospital or convalescent bed that is highly successful in its ability to turn a patient over.

A further objective is to provide such a bed that is of simple construction and therefore low cost.

A still further objective is to provide such a bed that may be automated in its movements.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention. In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications what is described herein without departing from its spirit and scope. Therefore, it must be understood that what is illustrated is set forth only for the purposes of example and that it should not be taken as a limitation in the scope of the present apparatus and method of use.

Figure 2:
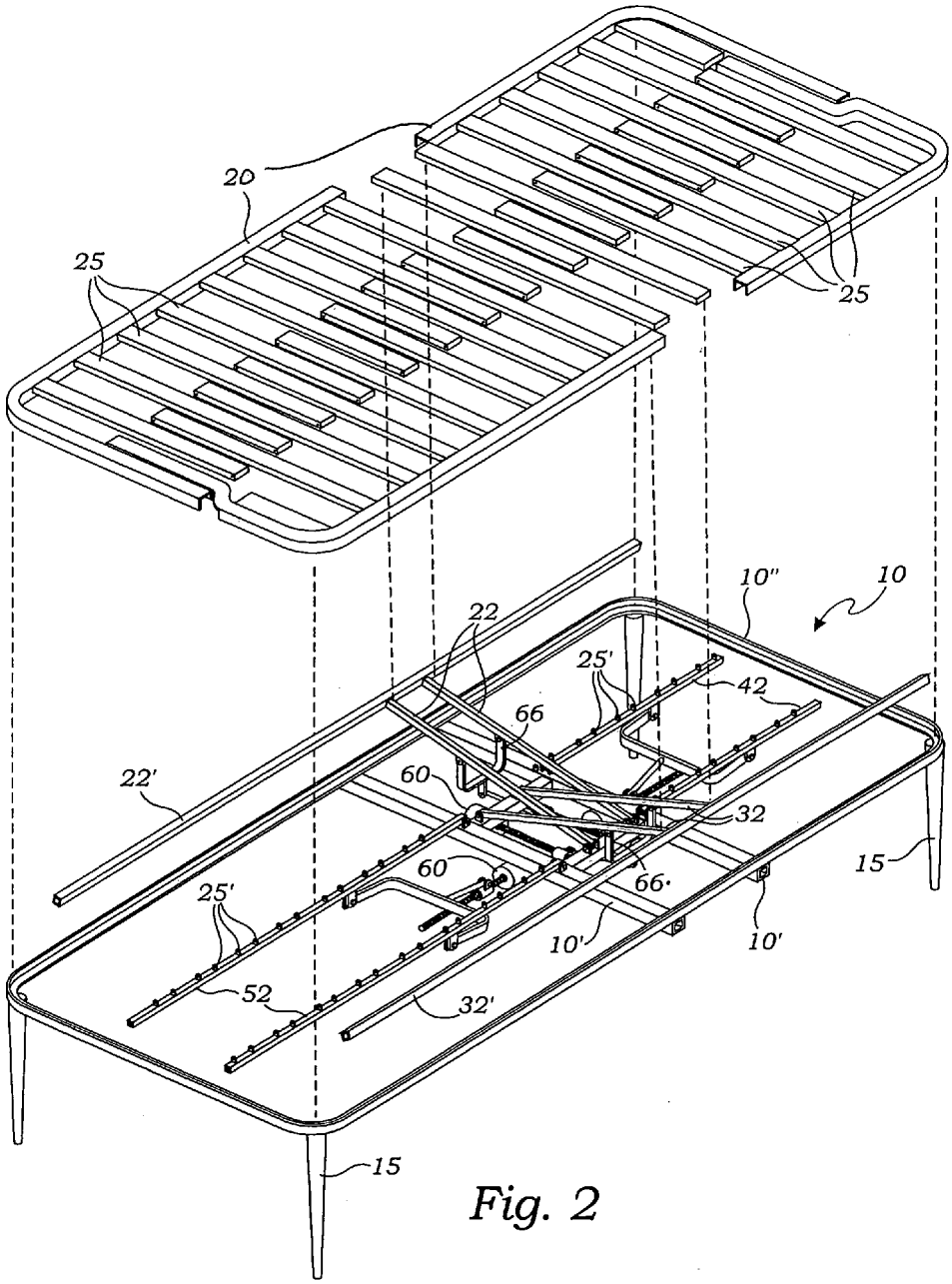
FIG. 2 is an exploded view thereof.

Described now in detail is an articulated bed apparatus of particular use as a hospital or convalescent bed. As shown in FIG. 2, the apparatus has a stationary base frame 10 mounted on legs 15, the base frame 10 comprising an outer rim 10" made of L-channel stock with an integral inner H-frame 10' made up of box tubes with welded construction. A cover frame 20 provides peripheral portions that initially are nested over corresponding portions of the outer rim 10" and, as will be described, may be lifted above outer rim 10".

Figure 1:
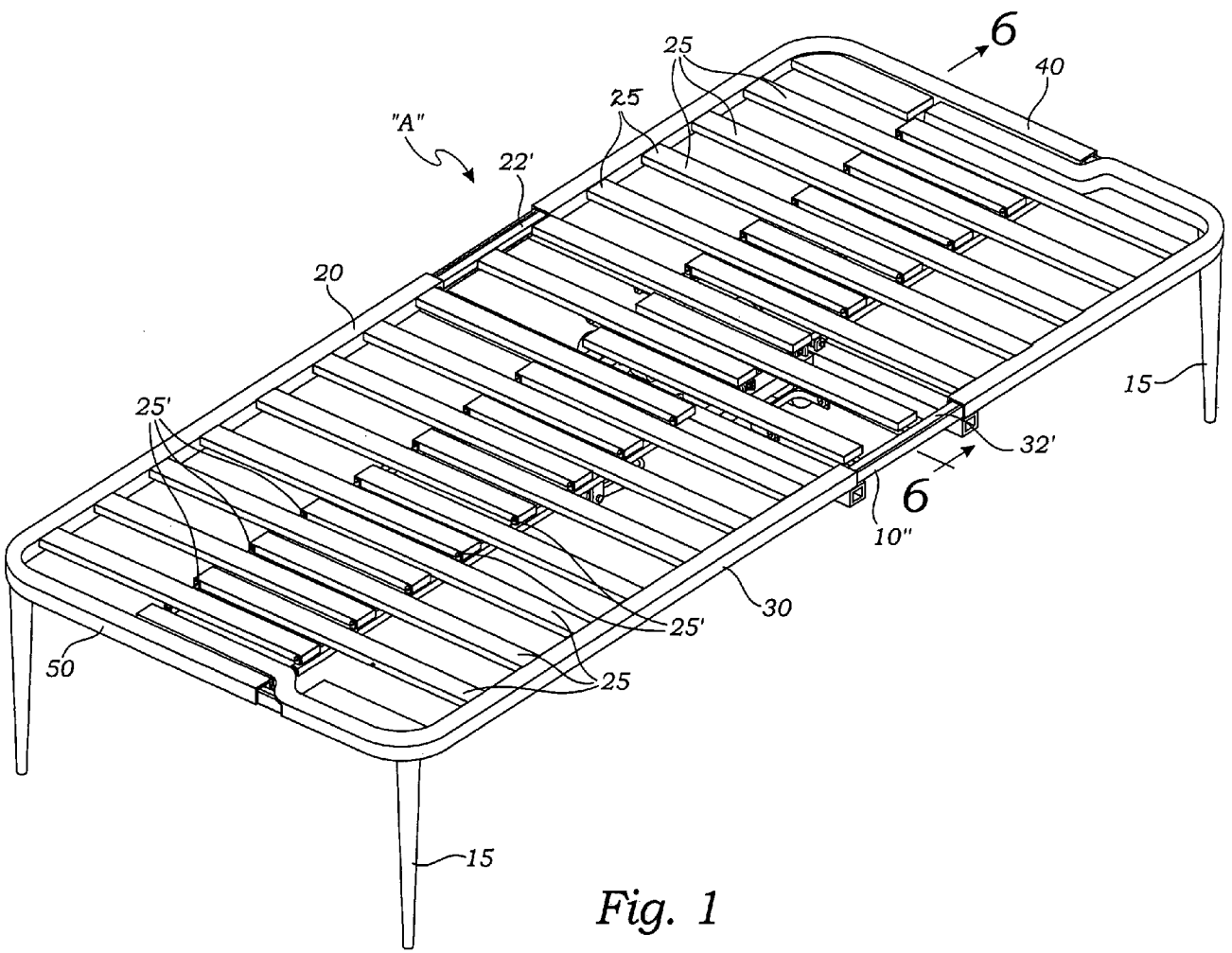
FIG. 1 is a perspective view of the presently described apparatus.
Figure 5:
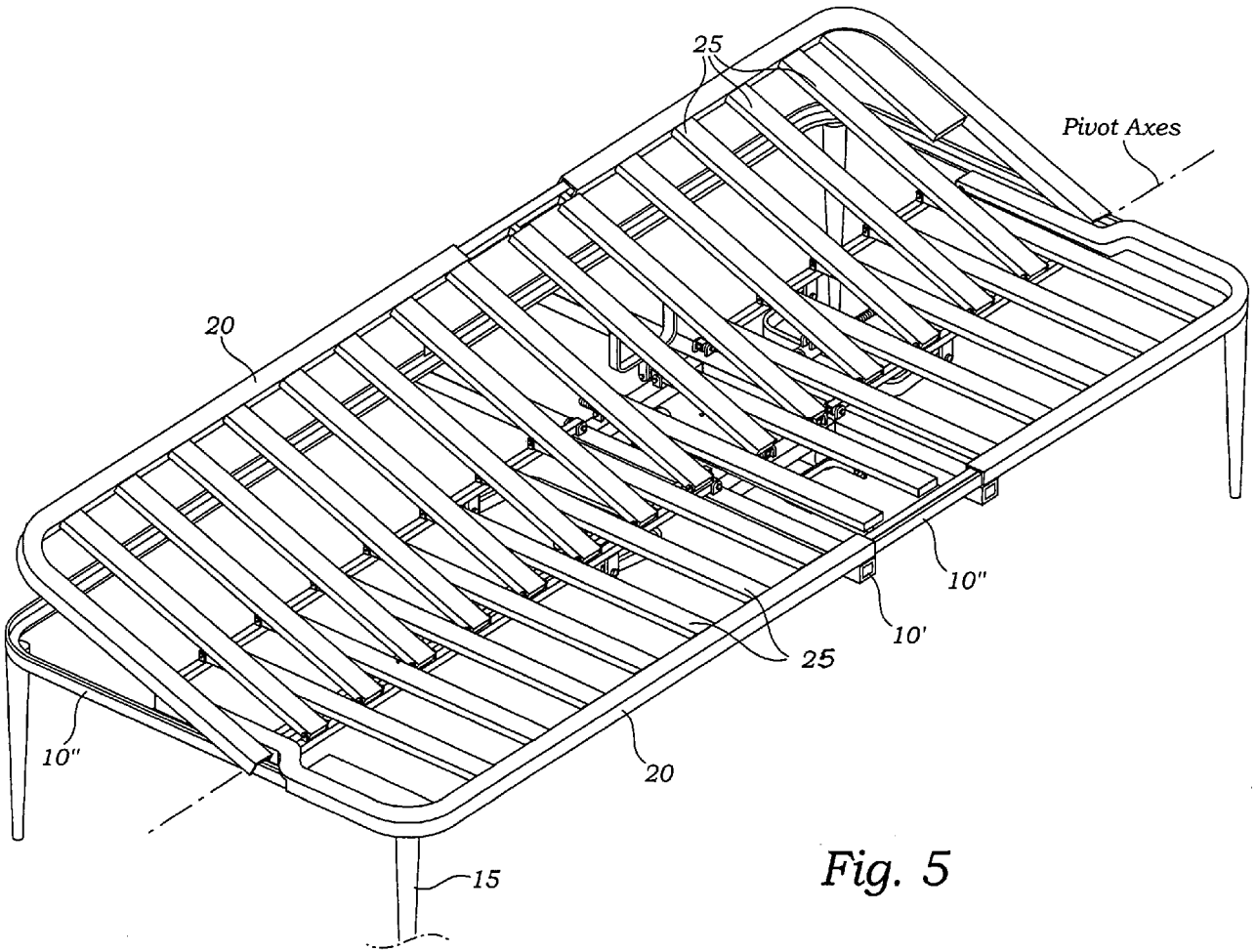
FIG. 5 is a perspective view thereof showing a left side section raised.
Figure 6:
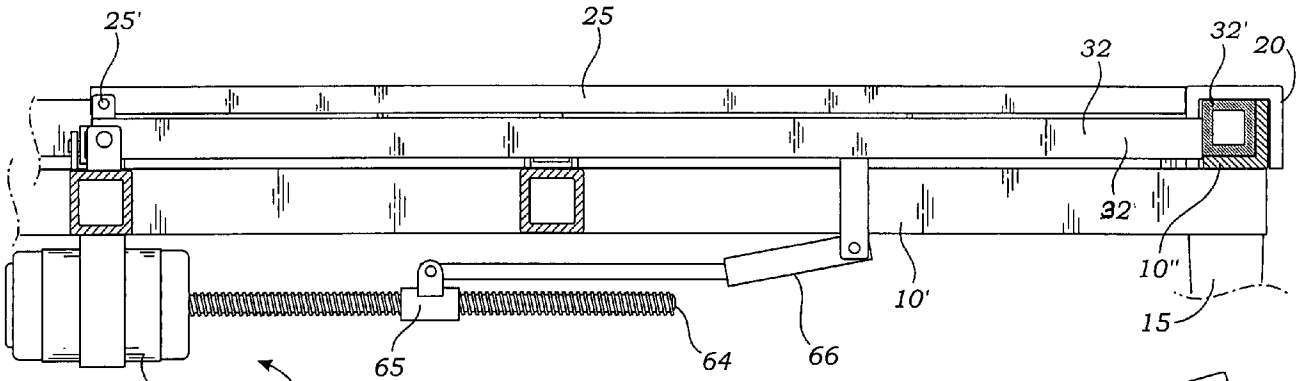
FIG. 6 is a partial sectional view taken from FIG. 1 along line 6—6.
Figure 7:
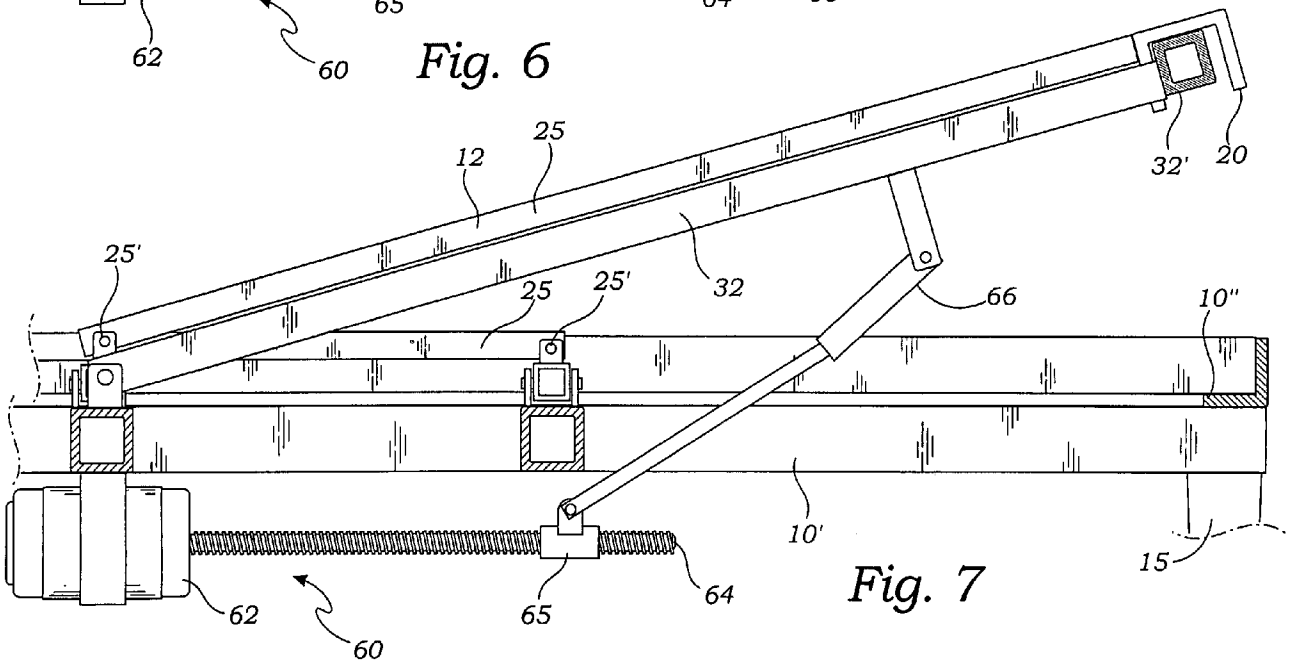
FIG. 7 is a partial sectional view taken from FIG. 4 along line 7—7.

As shown in FIG. 1, a plurality of mattress support sections, together define a mattress support area "A" comprising the entire up-facing surface shown. The support sections include a left section 20, a right section 30, a head section 40 and a foot section 50. These sections are movable between a laying flat attitude as shown in FIGS. 1 and 6, and a raised attitude as shown in FIGS. 3, 4, 5 and 7. In order to lift the four sections 20, 30, 40 and 50, lifting mechanisms 60 are employed. A plurality of lift arm pairs 22, 32, 42 and 52, are hingably mounted to the H-frame 10' as shown in FIG. 2 and extend laterally (pairs 22 and 32) and longitudinally (pairs 42 and 52). Arms 22 and 32 terminate (are welded to) lift bars 22' and 32' respectively which lie on the base frame 10 at either side. The ends of arms 42 and 52 are free. Electric motors 62 are mounted as shown in FIGS. 2, 6 and 7, and employ drive screws 64 to move traveler nuts 65 which are pivotally engaged with yolks 66. As nuts 65 move along screws 64, the yolks 66 push lift arm pairs 22, 32, 42 and 52 upward to raise the several sections. As shown in all of the views a plurality of mattress support plates 25 are mounted by hinges 25' (FIG. 2) to the lift arms 42 and 52. As shown in FIG. 5, the plates 25 positioned between sections 40 and 50 are mounted on, and move with lift arms 22 and 32.

Of significant utility and novelty in the present invention is the fact that the left 20 and right 30 sections are hingably interleaved, meaning that each of these sections comprises more than 50 percent of the surface area "A". This is clearly shown in FIGS. 4 and 5 as the right section shown in FIG. 4, when raised, extends to the left beyond the center of the area "A" and in FIG. 5, when raised, extends to the right beyond the center of the area "A" as well. This is advantageous in that it is more efficient then prior art articulated beds in turning a patient because the patient can be moved no matter where on surface area "A" he/she may be located. For instance, if the patient is centered in area "A", by raising section 20 or 30, the patient is either turned over completely, or moved away laterally by the raised section without turning over. If the patient is not turned over, then the other one of sections 20 or 30 may be raised to definitely turn the patient over. Because prior art beds raise no more than about 50% of the mattress surface at one time, they are unable, for instance, to turn a large and heavy individual who is positioned at the center of the bed.

Figure 3:
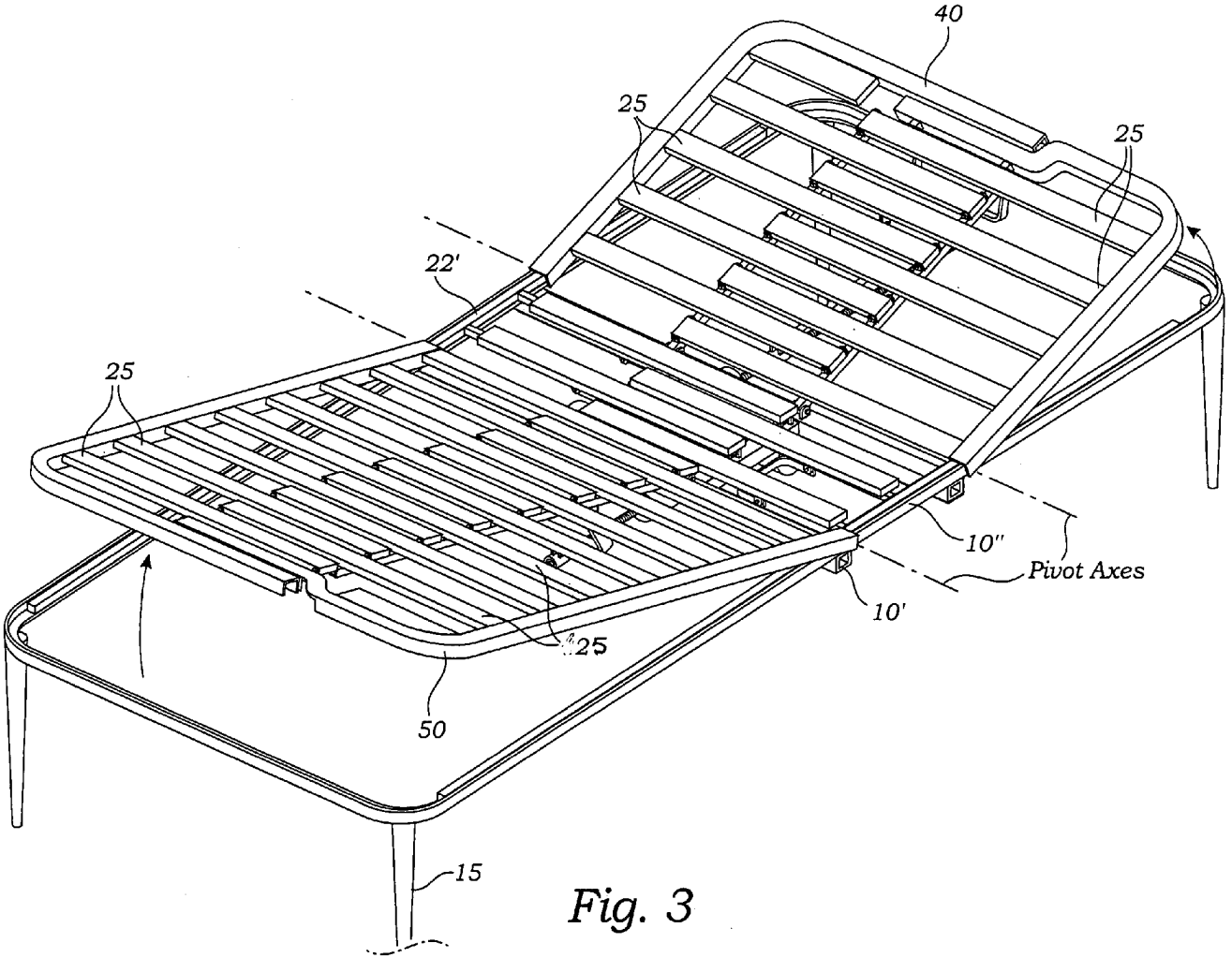
FIG. 3 is a perspective view thereof showing head and foot sections raised.
Figure 4:
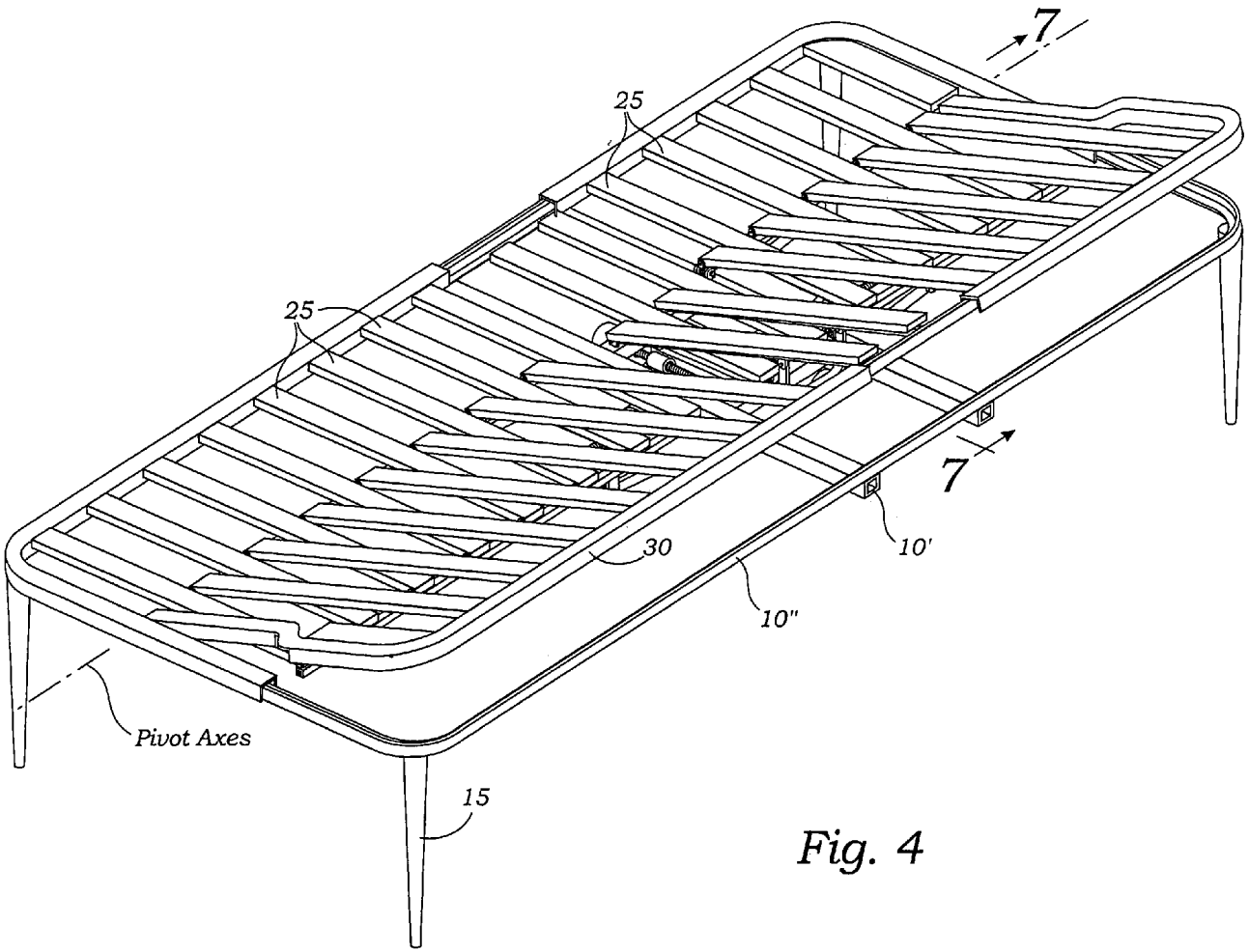
FIG. 4 is a perspective view thereof showing a right side section raised.

In operation, it is seen that section 20 (FIG. 5) is able to rotate about a pivot axis; while section 30 (FIG. 4) is able to rotate about a further pivot axis. In FIG. 3, it is seen that sections 40 and 50 are able to rotate about still further pivot axes so that each of sections may be raised independently of the others and each may be raised alone or with the others.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. An articulated bed comprising:

a first section configured to support at least part of a mattress thereon, the first section comprising a first side rail and a plurality of first mattress support bars extending generally parallel to one another, each first mattress support bar comprising a first end and a second end, the first end being fixed to the first side rail so as to integrate each first mattress support bar with the first side rail, wherein each first mattress support bar is hinged about a first axis at a point of the first mattress support bar so as to rotate about the first axis, wherein the point of each first mattress support bar is located at or in the vicinity of the second end of the first mattress support bar;

a second section located next to the first section and configured to support at least part of a mattress thereon; and a lifting mechanism configured to engage with the first section and to lift the first side rail so as to rotate the first side rail and the plurality of first mattress support bars rotate about the first axis.

2. The articulated bed of claim 1, wherein each first mattress support bar extends generally perpendicular to the first side rail.

3. The articulated bed of claim 1, further comprising a hinge support extending along the first axis under the plurality of first mattress support bars and configured to provide each first mattress support bar with a hinged connection about the first axis.

4. The articulated bed of claim 1, wherein the lifting mechanism comprises a first lifting bar arranged to extend along the first side rail and configured to be lifted, wherein the first side rail and the first lifting bar are configured to engage with each other such that lifting the first lifting bar lifts the first side rail and simultaneously rotates the first side rail and the plurality of first mattress support bars about the first axis.

5. The articulated bed of claim 4, wherein the lifting mechanism further comprises at least two lifting arms substantially perpendicularly attached to the first lifting bar and configured to rotate generally about the first axis so as to lift the first lifting bar.

6. The articulated bed of claim 4, wherein the first side rail has a recess from an underside thereof, and wherein the recess is configured to receive the first lifting bar from the underside.

7. The articulated bed of claim 4, further comprising a frame configured to support the first section, the second section and the lifting mechanism.

8. The articulated bed of claim 7, wherein the frame comprises a first side bar extending along the first side rail and configured to receive the first lifting bar thereon.

9. The articulated bed of claim 1, wherein the second section comprises a second side rail and a plurality of second mattress support bars extending generally parallel to one another, each second mattress support bar comprising a first end and a second end, the first end being fixed to the second side rail so as to integrate each second mattress support bar with the second side rail.

10. The articulated bed of claim 9, wherein each second mattress support bar of the second section is hinged about a second axis at a point of the second mattress support bar apart from the first end of the second mattress support bar so as to rotate about the second axis, and wherein the lifting mechanism is further configured to engage with the second section and to lift the second side rail so as to rotate the second side rail and the plurality of second mattress support bars about the second axis substantially parallel to the first axis.

11. The articulated bed of claim 9, wherein two neighboring ones of the plurality of first mattress support bars from a space therebetween, and wherein one of the plurality of second mattress support bars extends into the space.

12. The articulated bed of claim 9, wherein the second end of each first mattress support bar is spaced apart from the first side rail.

13. The articulated bed of claim 4, wherein the first section further comprises a second side rail and a plurality of second mattress support bars extending generally parallel to one another, each second mattress support bar comprising a first end and a second end, the first end being fixed to the second side rail so as to integrate each second mattress support bar with the second side rail, wherein the second side rail extends along the first side rail while spaced apart from the first side rail.

14. The articulated bed of claim 13, wherein each second mattress support bar is hinged about the first axis at a point of the second mattress support bar apart from the first end of the second mattress support bar so as to rotate about the first axis, and wherein the lifting mechanism is further configured to lift the second side rail so as to rotate the second side rail and the plurality of second mattress support bars rotate about the first axis.

15. The articulated bed of claim 13, wherein the lifting mechanism is configured to lift the first and second side rails simultaneously so as to rotate the first section about the first axis.

16. The articulated bed of claim 13, further comprising another lifting mechanism configured to rotate the first side rail and the plurality of first mattress support bars about a third axis substantially perpendicular to the first axis.

17. The articulated bed of claim 16, wherein the lifting mechanism and the other lifting mechanism are interconnected.

18. The articulated bed of claim 16, further comprising another lifting mechanism configured to rotate the second side rail and the plurality of second mattress support bars about a fourth axis substantially perpendicular to the first axis.

19. The articulated bed of claim 16, wherein the other lifting mechanism is further configured to rotate a portion of the second section together with the first side rail and the plurality of first mattress support bars about the third axis.

20. The articulated bed of claim 13, wherein the first section further comprises at least one mattress support bar, each of which comprises a first end and a second end, wherein the first end of each mattress support bar is fixed to neither the first side rail nor the second side rail, and wherein the second end of each mattress support bar is hinged about the first axis at a point of the mattress support bar apart from the first end thereof, wherein each mattress support bar is rotatable about the first axis.

21. The articulated bed of claim 1, wherein the first section comprises a left or right portion of the bed.

22. The articulated bed of claim 21, wherein the left or right portion occupies more than one half the areas on which a mattress is to be supported.

23. The articulated bed of claim 1, wherein the first section comprises a head or leg portion of a left or right portion of the bed.

24. The articulated bed of claim 1, wherein the first side rail provides a side edge of the bed on which a mattress is to be placed.

25. The articulated bed of claim 24, further comprising a mattress.

26. A method of using an articulated bed, the method comprising:

providing the articulated bed of claim 1; and lifting the first side rail using the lifting mechanism so as to rotate the first side rail and the plurality of first mattress support bars about the first axis while maintaining the second section in an original position thereof.

27. The method of claim 26, wherein lifting the first side rail causes a person lying on the bed to turn the body of the person to a side.

28. The method of claim 26, wherein the articulated bed further comprises another lifting mechanism configured to rotate the first side rail and the plurality of first mattress support bars about a third axis substantially perpendicular to the first axis, wherein the method further comprises lifting the first side rail using the other lifting mechanism so as to rotate the first side rail and the plurality of first mattress support bars about the third axis.

29. The method of claim 28, wherein the other lifting mechanism is further configured to rotate a portion of the second section together with the first side rail and the plurality of first mattress support bars about the third axis, wherein the method further comprises substantially simultaneously rotating the first side rail, and the plurality of first mattress support bars and the portion of the second section about the third axis.

* * * * *